US008946139B2

(12) United States Patent
Batchelor et al.

(10) Patent No.: US 8,946,139 B2
(45) Date of Patent: Feb. 3, 2015

(54) LIQUID LAUNDRY COMPOSITION

(75) Inventors: Stephen Norman Batchelor, Wirral (GB); Jayne Michelle Bird, Wirral (GB)

(73) Assignee: Conopco Inc., Englewood Cliffs, NJ (US)

( * ) Notice: Subject to any disclaimer, the term of this patent is extended or adjusted under 35 U.S.C. 154(b) by 0 days.

(21) Appl. No.: 14/118,898

(22) PCT Filed: Feb. 14, 2012

(86) PCT No.: PCT/EP2012/052460

§ 371 (c)(1), (2), (4) Date: Nov. 20, 2013

(87) PCT Pub. No.: WO2012/159778

PCT Pub. Date: Nov. 29, 2012

(65) Prior Publication Data

US 2014/0082853 A1 Mar. 27, 2014

(30) Foreign Application Priority Data

May 26, 2011 (EP) ..... 11167583

(51) Int. Cl.

| | |
|---|---|
| ***C11D 3/382*** | (2006.01) |
| ***C11D 3/40*** | (2006.01) |
| ***C11D 1/00*** | (2006.01) |
| ***B08B 3/04*** | (2006.01) |
| ***C11D 3/42*** | (2006.01) |

(52) U.S. Cl.

CPC *C11D 3/42* (2013.01); *C11D 3/382* (2013.01); *C11D 3/40* (2013.01)

USPC ..... 510/462; 510/343; 510/344; 510/419; 510/464; 8/137

(58) Field of Classification Search

USPC ..... 510/343, 344, 419, 462, 464; 8/137

See application file for complete search history.

(56) References Cited

U.S. PATENT DOCUMENTS

| | | | | |
|---|---|---|---|---|
| 4,283,197 | A | 8/1981 | Schurings | |
| 4,762,636 | A | 8/1988 | Balliello | |
| 4,874,537 | A | 10/1989 | Peterson et al. | |
| 5,104,584 | A * | 4/1992 | Kong | 510/309 |

FOREIGN PATENT DOCUMENTS

| | | | | |
|---|---|---|---|---|
| FR | 1594816 | | 6/1970 | |
| GB | 1242689 | | 8/1971 | |
| WO | WO03062254 | A1 | 7/2003 | |
| WO | WO2006032397 | A1 | 3/2006 | |
| WO | WO2006045375 | | 5/2006 | |
| WO | WO2006053598 | A1 | 5/2006 | |
| WO | WO2007006357 | A1 | 1/2007 | |
| WO | WO 2010/033743 | * | 3/2010 | C08H 6/00 |
| WO | WO2010033743 | A1 | 3/2010 | |
| WO | WO2010084039 | A1 | 7/2010 | |

OTHER PUBLICATIONS

PCT International Search Report in PCT application PCT/EP2012/052460 dated May 7, 2012 with Written Opinion.

European Search Report in EP application EP 11 16 7583 dated Oct. 10, 2011.

PCT International Seach Report in PCT application PCT/EP2010/050138 dated Mar. 24, 2010 with Written Opinion.

European Search Report in EP application EP 09 15 1297 dated Aug. 20, 2009.

World Wide ChemNet Colour Index, "Acid Blue7", C.I. No. C.I. 42080, http://www.chemnet.com/resource/colour/supplier.cgi?exact=dict&f=plist&l=en&terms=3486-30-4&id=287.

* cited by examiner

*Primary Examiner* — Brian P Mruk

(74) *Attorney, Agent, or Firm* — Greenberg Traurig, LLP

(57) ABSTRACT

The present invention concerns liquid laundry formulations incorporating a modified lignin polymer.

12 Claims, No Drawings

LIQUID LAUNDRY COMPOSITION

TECHNICAL FIELD

The present invention concerns liquid laundry formulations incorporating a modified lignin polymer.

BACKGROUND OF THE INVENTION

WO/2010/033743 (Procter & Gamble) disclosed Novel modified lignin polymers containing anionic, cationic, and/or alkoxy substitution are disclosed. Further, new cleaning compositions including the novel substituted lignin polymers are disclosed. Methods of forming the modified lignin polymers and cleaning compositions are disclosed. Example 5 of WO/2010/033743 discloses a non-tinting dye, Acid Blue 7, with a modified lignin polymer; non-tinting dyes are used purely for product aesthetics. Non-tinting dyes are not substantive to cloth and do not provide a shading benefit.

WO2003/062254 (Procter & Gamble) discloses laundry detergent compositions comprising a lignin-derived material selected from the group consisting of lignin phenols and lignin phenols comprising an amino-substituent.

WO2010/084039 (Unilever) disclosed shading dyes in spray dried granules containing lignin sulphonate for use in powder detergents.

Shading dyes are added to laundry formulations to enhance the whiteness of fabrics. Shading dyes are preferably blue or violet dyes which are substantive to fabric.

In liquid detergents containing shading dyes, when the product is applied in neat contact, directly to fabric a blue or violet stain may occurs. There is a need for liquid detergents containing shading dyes that have reduced staining when the product is applied in neat contact, directly to fabric and upon use provide shading benefits.

SUMMARY OF THE INVENTION

We have found that a liquid formulation containing a shading dye, surfactant, and a modified lignin polymer has reduced staining properties on neat contact with a textile. The liquid laundry detergent formulation containing a shading dye and a modified lignin polymer has reduced staining when applied directly to fabric and acceptable dye deposition to a fabric when used under domestic conditions.

In one aspect the present invention provides a liquid laundry composition comprising:

(a) from 0.00001 to 1.0 wt % of a shading dye, preferably 0.0001 to 0.1 wt %, more preferably 0.001 to 0.01 wt %;

(b) from 1 to 70 wt % of a surfactant;

(c) from 0.1 to 30 wt % of a modified lignin polymer, preferably from 0.4 to 11 wt %; and, (d) the remainder of the composition being diluents and adjuncts to 100 wt %.

In another aspect the present invention provides a method of treating a textile comprising the steps of:

(i) applying the liquid laundry composition to a textile;

(ii) rinsing the textile with water; and, (iii) optionally drying the textile.

DETAILED DESCRIPTION OF THE INVENTION

Shading Dye

Shading dyes deposit to fabric during the wash or rinse step of the washing process providing a visible hue to the fabric. Preferably the shading dye is a blue or violet shading dye. A mixture of shading dyes may be used and indeed are preferred for treating mixed fibre textiles.

Shading dyes are discussed in WO2005/003274, WO2006/032327 (Unilever), WO2006/032397 (Unilever), WO2006/045275 (Unilever), WO 2006/027086 (Unilever), WOO2008/017570 (Unilever), WO 2008/141880 (Unilever), WO2009/132870 (Unilever), WO 2009/141173 (Unilever), WO 2010/099997 (Unilever), WO 2010/102861 (Unilever), WO 2010/148624 (Unilever), WO2008/087497 (P&G) and WO2011/011799 (P&G).

Shading of white garments may be done with any colour depending on consumer preference. Blue and Violet are particularly preferred shades and consequently preferred dyes or mixtures of dyes are ones that give a blue or violet shade on white fabrics. The shading dyes used in the present invention are preferably blue or violet. In this regard the dye gives a blue or violet colour to a white cloth with a hue angle of 240 to 345, more preferably 260 to 320, most preferably 270 to 300. The white cloth used is bleached non-mercerised woven cotton sheeting.

The shading dye chromophore is preferably selected from the group comprising: mono-azo, bis-azo, triphenodioxazine, phthalocyanin, naptholactam, azine and anthraquinone. Most preferably mono-azo, bis-azo, azine and anthraquinone. Preferably the shading dye is not a triphenylmethane dye.

Most preferably the dye bears at least one sulfonate group.

Many examples of shading dyes are found in the classes of basic, solvent, acid, direct and disperse dyes.

Preferred shading dyes are selected from direct dyes, acid dyes, hydrophobic dyes, cationic dyes and reactive dyes.

Direct Dyes

Direct violet and direct blue dyes are preferred.

Preferably the dye is a bis-azo dye.

Most preferably, the direct dye is a direct violet of the following structures:

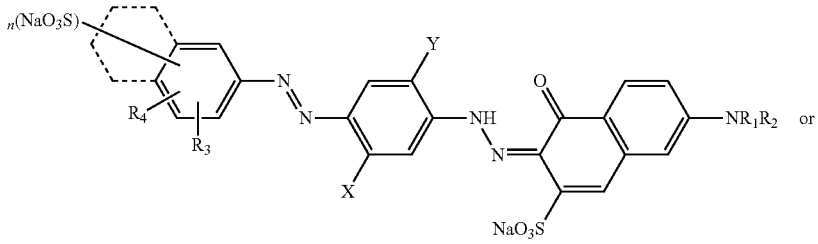

-continued

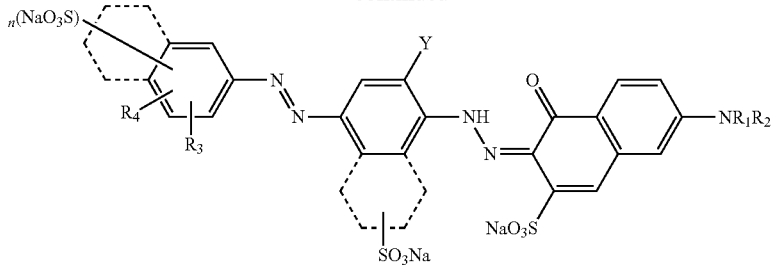

wherein:

the ring bearing $R_3$ and $R_4$ may be independently naphthyl or phenyl as shown;

$R_1$ is selected from: hydrogen and C1-C4-alkyl, preferably hydrogen;

$R_2$ is selected from: hydrogen, C1-C4-alkyl, substituted or unsubstituted phenyl and substituted or unsubstituted naphthyl, preferably phenyl;

$R_3$ and $R_4$ are independently selected from: hydrogen and C1-C4-alkyl, preferably hydrogen or methyl;

X and Y are independently selected from: hydrogen, C1-C4-alkyl and C1-C4-alkoxy; preferably the dye has X=methyl; and, Y=methoxy and n is 0, 1 or 2, preferably 1 or 2.

Preferred dyes are direct violet 7, direct violet 9, direct violet 11, direct violet 26, direct violet 31, direct violet 35, direct violet 40, direct violet 41, direct violet 51, and direct violet 99. Bis-azo copper containing dyes such as direct violet 66 may be used.

The benzidene based dyes are not preferred.

Preferably the direct dye is present at 0.00001 wt % to 0.0010 wt % of the formulation.

In another embodiment the direct dye may be covalently linked to the photo-bleach, for example as described in WO2006/024612 and WO2010/099997.

Acid Dyes

Cotton substantive acid dyes give benefits to cotton containing garments. Preferred dyes and mixes of dyes are blue or violet. Preferred acid dyes are:

(i) azine dyes, wherein the dye is of the following core structure:

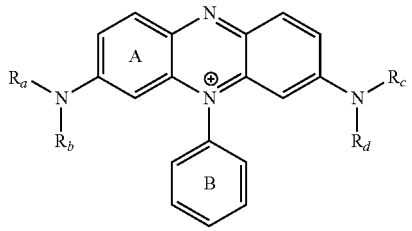

wherein $R_a$, $R_b$, $R_c$ and $R_d$ are selected from: H, an branched or linear C1 to C7-alkyl chain, benzyl a phenyl, and a naphthyl;

the dye is substituted with at least one $SO_3^-$ or —$COO^-$ group;

the B ring does not carry a negatively charged group or salt thereof;

and the A ring may further substituted to form a naphthyl;

the dye is optionally substituted by groups selected from: amine, methyl, ethyl, hydroxyl, methoxy, ethoxy, phenoxy, Cl, Br, I, F, and $NO_2$.

Preferred azine dyes are: acid blue 98, acid violet 50, and acid blue 59, more preferably acid violet 50.

Other preferred non-azine acid dyes are acid violet 17, acid black 1 and acid blue 29.

Preferably the acid dye is present at 0.0005 wt % to 0.01 wt % of the formulation.

Hydrophobic Dyes

The composition may comprise one or more hydrophobic dyes selected from benzodifuranes, methine, triphenylmethanes, napthalimides, pyrazole, napthoquinone, anthraquinone and mono-azo or di-azo dye chromophores. Hydrophobic dyes are dyes which do not contain any charged water solubilising group. Hydrophobic dyes may be selected from the groups of disperse and solvent dyes. Blue and violet anthraquinone and mono-azo dye are preferred.

Preferred dyes include solvent violet 13, disperse violet 27 disperse violet 26, disperse violet 28, disperse violet 63 and disperse violet 77.

The hydrophobic dye may be an alkoxylated dye, preferably an alkoxylated mono-azo thiophene dye.

Preferably the hydrophobic dye is present at 0.0001 wt % to 0.01 wt % of the formulation.

Cationic Dyes

Cationic dyes bear a cationic charge. Cationic mono-azo, phenazines, triphenyl methane and anthraquinone dyes are preferred. Cationic Mono-azo dye and phenazine dyes are most preferred. To avoid hydrolysis for mono-azo and anthraquinone dyes preferably the cationic charge is present as a quaternary amine on a pendant chain. The dyes may be alkoxylated and mono-azo dyes may additionally bear anionic charged groups, preferably also on pendant chains. Mono-azo dyes containing a hetrocyclic ring are particularly preferred, such as thiophenes.

Preferred cationic phenazine dyes are of the form:

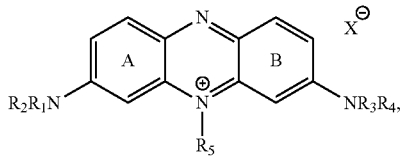

wherein X− is a negative anion;

no more than three of the groups R1, $R_2$, $R_3$ and $R_4$ are H and are independently selected from: a polyether chain, benzyl, phenyl, amine substituted benzyl, amine substituted phenyl, alkyl substituted phenyl, $COCH_3$, H, a linear or branched alkyl chains; a linear or branched alkyl chains which is substituted by one or more groups selected from: ester groups; Cl; F; CN; OH; $CH_3O$—; $C_2H_5O$—; and, phenyl; $R_5$ is selected from the group consisting of: a branched or linear C1 to C10 alkyl; a branched or linear C1 to C10 alkyl group substituted by a phenyl group; and, an aromatic group;

one or more of rings A or B may be further substituted to form a naphthyl ring; and, the dye is not covalently bound to a negatively charged substituent.

Reactive Dyes

Reactive dyes are dyes which contain an organic group capable of reacting with an aliphatic C—OH, C—NH2 or C—NH—C group to form a covalent bond. They deposit onto cotton.

Preferably the reactive group is hydrolysed or reactive group of the dyes has been reacted with an organic species such as a polymer, so as to the link the dye to this species. Dyes may be selected from the reactive violet and reactive blue dyes listed in the Colour Index International. Examples of suitable polymers are polysaccharides, polyamines and polyalcohols.

Preferred examples include reactive blue 19, reactive blue 163, reactive blue 182 and reactive blue 171, reactive blue 96.

Dyes linked to polymers are also preferred as a shading agents.

Modified Lignin Polymer

Lignin is a component of all vascular plants, found mostly between cellular structures but also within the cells and in the cell walls.

A modified lignin polymers is lignin that has been subjected to a chemical reaction to covalently attach chemical moieties to the lignin. The attached chemical moieties are usually randomly substituted.

Preferred modified lignin polymers are lignins that have been substituted with anionic, cationic or alkoxy groups, or mixtures thereof. Preferably the substitution occurs on the aliphatic portion of the lignin and is random. A preferred anionic group is a sulfonate. A preferred cationic group is a quanternary amine. Preferred alkoxy groups are polyalkylene oxide chains having repeat units of alkoxy moieties in the range from 5 to 30, most preferably ethoxy. Preferably the modified lignin sulfonate is substituted with anionic or alkoxy groups. Modified lignin polymers are discussed in WO/2010/033743. Most preferably the modified lignin polymer is lignin sulfonate (lignosulfonate). Lignin sulfonate may be obtained by the Howard process.

Exemplary lignin sulfonate may be obtained from a variety of sources including hardwoods, softwoods and recycling or effluent streams. The lignin sulfonate may be utilized in crude or pure forms, e.g., in an "as is" or whole liquor condition, or in a purified lignin sulfonate form from which or in which sugars and other saccharide constituents have been removed or destroyed, or from which or in which inorganic constituents have been partially or fully eliminated. The lignin sulfonate may be utilized in salt forms including calcium lignin sulfonate, sodium lignin sulfonate, ammonium lignin sulfonate, potassium lignin sulfonate, magnesium lignin sulfonate and mixtures or blends thereof.

The lignin sulfonate preferably has a weight average molecular weight of from 2000 to 100000. Their basic structural unit is phenylpropane. The degree of sulfonation is preferably from 0.3 and 1.0 sulfate groups per phenylpropane unit.

Lignin sulfonate are available from a number of suppliers including Borregaard LignoTech, Georgia-Pacific Corporation, Lenzing AG and Tembec Inc. Lignin sulfonates are discussed in Lauten, R. A., Myrvold, B. O. and Gundersen, S. A. (2010) New Developments in the Commercial Utilization of Lignosulfonates, in Surfactants from Renewable Resources (eds M. Kjellin and I. Johansson), John Wiley & Sons, Ltd, Chichester, UK.

Surfactant

The composition comprises between 1 to 70 wt % of a surfactant, most preferably 10 to 30 wt %. The surfactant acts as a detergent. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981. Preferably the surfactants used are saturated.

Suitable nonionic detergent compounds which may be used include, in particular, the reaction products of compounds having a hydrophobic group and a reactive hydrogen atom, for example, aliphatic alcohols, acids, amides or alkyl phenols with alkylene oxides, especially ethylene oxide either alone or with propylene oxide. Specific nonionic detergent compounds are $C_6$ to $C_{22}$ alkyl phenol-ethylene oxide condensates, generally 5 to 25 EO, i.e. 5 to 25 units of ethylene oxide per molecule, and the condensation products of aliphatic $C_8$ to $C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

In another aspect which is also preferred the surfactant may be a cationic such that the formulation is a fabric conditioner.

To facilitate ease of use the formulation is preferably packed in pack sizes of 0.5 to 5 kg. To reduce moisture ingress, the formulation is preferably packs in laminated cardboard packs or sealed plastic bags.

Diluents and Adjuncts

The diluents and adjuncts facilitate the composition are generally other than the shading dye, surfactant; and the modified lignin polymer. The diluents and adjuncts may facilitate fluidization of the composition and/or provide bulking or functionality to the formulation. These include water, alcohol etc. Below are found suitable diluents and adjuncts but the composition is not limited to such.

Detergency Builder

One or more detergency builders may be suitably present in the liquid detergent composition of the invention.

Examples of suitable organic detergency builders, when present, include the alkaline metal, ammonium and substituted ammonium polyacetates, carboxylates, polycarboxylates, polyacetyl carboxylates, carboxymethyloxysuccinates, carboxymethyloxymalonates, ethylene diamine-N,N-disuccinic acid salts, polyepoxysuccinates, oxydiacetates, triethylene tetramine hexa-acetic acid salts, N-alkyl imino diacetates or dipropionates, alpha sulpho-fatty acid salts, dipicolinic acid salts, oxidised polysaccharides, polyhydroxysulphonates and mixtures thereof.

Specific examples include sodium, potassium, lithium, ammonium and substituted ammonium salts of ethylenediamino-tetraacetic acid, nitrilo-triacetic acid, oxydisuccinic acid, melitic acid, benzene polycarboxylic acids and citric acid, tartrate mono succinate and tartrate di succinate.

Fluorescent Agent

The composition preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt %, more preferably 0.01 to 0.1 wt %. Preferred classes of fluorescer are: Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Blankophor SN. Preferred fluorescers are: sodium 2(4-styryl-3-sulfophenyl)-2H-napthol[1,2-d]triazole, disodium 4,4'-bis{[(4-anilino-6-(N methyl-N-2hydroxyethyl)amino 1,3,5-triazin-2-yl)] amino}stilbene-2-2'disulfonate, disodium 4,4'-bis{[(4-anilino-6-morpholino-1,3,5-triazin-2-yl)]amino}stilbene-2-2'disulfonate, and disodium 4,4'-bis(2-sulfostyryl)biphenyl.

It is preferred that the aqueous solution used in the method has a fluorescer present. When a fluorescer is present in the aqueous solution used in the method it is preferably in the range from 0.0001 g/l to 0.1 g/l, preferably 0.001 to 0.02 g/l.

Perfume

Preferably the composition comprises a perfume. The perfume is preferably in the range from 0.001 to 3 wt %, most preferably 0.1 to 1 wt %. Many suitable examples of perfumes are provided in the CTFA (Cosmetic, Toiletry and Fragrance Association) 1992 International Buyers Guide, published by CFTA Publications and OPD 1993 Chemicals Buyers Directory 80th Annual Edition, published by Schnell Publishing Co.

It is commonplace for a plurality of perfume components to be present in a formulation. In the compositions of the present invention it is envisaged that there will be four or more, preferably five or more, more preferably six or more or even seven or more different perfume components.

In perfume mixtures preferably 15 to 25 wt % are top notes. Top notes are defined by Poucher (Journal of the Society of Cosmetic Chemists 6(2):80 [1955]). Preferred top-notes are selected from citrus oils, linalool, linalyl acetate, lavender, dihydromyrcenol, rose oxide and cis-3-hexanol.

Perfume and top note may be used to cue the whiteness benefit of the invention.

It is preferred that the laundry treatment composition does not contain a peroxygen bleach, e.g., sodium percarbonate, sodium perborate, and peracid.

Polymers

The composition may comprise one or more other polymers. Examples are carboxymethylcellulose, poly (ethylene glycol), poly(vinyl alcohol), polycarboxylates such as polyacrylates, maleic/acrylic acid copolymers and lauryl methacrylate/acrylic acid copolymers.

Polymers present to prevent dye deposition, for example poly(vinylpyrrolidone), poly(vinylpyridine-N-oxide), and poly(vinylimidazole), are preferably absent from the formulation.

Enzymes

One or more enzymes are preferred present in a composition of the invention and when practicing a method of the invention.

Preferably the level of each enzyme is from 0.0001 wt % to 0.1 wt % protein.

Especially contemplated enzymes include proteases, alpha-amylases, cellulases, lipases, peroxidases/oxidases, pectate lyases, and mannanases, or mixtures thereof.

Suitable lipases include those of bacterial or fungal origin. Chemically modified or protein engineered mutants are included. Examples of useful lipases include lipases from *Humicola* (synonym *Thermomyces*), e.g. from *H. lanuginosa* (*T. lanuginosus*) as described in EP 258 068 and EP 305 216 or from *H. insolens* as described in WO 96/13580, a *Pseudomonas* lipase, e.g. from *P. alcaligenes* or *P. pseudoalcaligenes* (EP 218 272), *P. cepacia* (EP 331 376), *P. stutzeri* (GB 1,372,034), *P. fluorescens, Pseudomonas* sp. strain SD 705 (WO 95/06720 and WO 96/27002), *P. wisconsinensis* (WO 96/12012), a *Bacillus* lipase, e.g. from *B. subtilis* (Dartois et al. (1993), Biochemica et Biophysica Acta, 1131, 253-360), *B. stearothermophilus* (JP 64/744992) or *B. pumilus* (WO 91/16422).

Other examples are lipase variants such as those described in WO 92/05249, WO 94/01541, EP 407 225, EP 260 105, WO 95/35381, WO 96/00292, WO 95/30744, WO 94/25578, WO 95/14783, WO 95/22615, WO 97/04079 and WO 97/07202, WO 00/60063.

Preferred commercially available lipase enzymes include Lipolase™ and Lipolase Ultra™, Lipex™, Lipoclean™ (Novozymes A/S).

The method of the invention may be carried out in the presence of phospholipase classified as EC 3.1.1.4 and/or EC 3.1.1.32. As used herein, the term phospholipase is an enzyme which has activity towards phospholipids.

Phospholipids, such as lecithin or phosphatidylcholine, consist of glycerol esterified with two fatty acids in an outer (sn-1) and the middle (sn-2) positions and esterified with phosphoric acid in the third position; the phosphoric acid, in turn, may be esterified to an amino-alcohol. Phospholipases are enzymes which participate in the hydrolysis of phospholipids. Several types of phospholipase activity can be distinguished, including phospholipases $A_1$ and $A_2$ which hydrolyze one fatty acyl group (in the sn-1 and sn-2 position, respectively) to form lysophospholipid; and lysophospholipase (or phospholipase B) which can hydrolyze the remaining fatty acyl group in lysophospholipid. Phospholipase C and phospholipase D (phosphodiesterases) release diacyl glycerol or phosphatidic acid respectively.

The enzyme and the shading dye may show some interaction and should be chosen such that this interaction is not negative. Some negative interactions may be avoided by encapsulation of one or other of enzyme or shading dye and/or other segregation within the product.

Suitable proteases include those of animal, vegetable or microbial origin. Microbial origin is preferred. Chemically modified or protein engineered mutants are included. The protease may be a serine protease or a metallo protease, preferably an alkaline microbial protease or a trypsin-like protease. Preferred commercially available protease enzymes include Alcalase™, Savinase™, Primase™, Duralase™, Dyrazym™, Esperase™, Everlase™, Polarzyme™, and Kannase™, (Novozymes A/S), Maxatase™, Maxacal™, Maxapem™, Properase™, Purafect™, Purafect OxP™, FN2™, and FN3™ (Genencor International Inc.).

The method of the invention may be carried out in the presence of cutinase. classified in EC 3.1.1.74. The cutinase used according to the invention may be of any origin. Preferably cutinases are of microbial origin, in particular of bacterial, of fungal or of yeast origin.

Suitable amylases (alpha and/or beta) include those of bacterial or fungal origin. Chemically modified or protein engineered mutants are included. Amylases include, for example, alpha-amylases obtained from *Bacillus*, e.g. a special strain of *B. licheniformis*, described in more detail in GB 1,296,839, or the *Bacillus* sp. strains disclosed in WO 95/026397 or WO 00/060060. Commercially available amylases are Duramyl™, Termamyl™, Termamyl Ultra™, Natalase™, Stainzyme™, Fungamyl™ and BAN™ (Novozymes A/S), Rapidase™ and Purastar™ (from Genencor International Inc.).

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g. the fungal cellulases produced from *Humicola insolens, Thielavia terrestris, Myceliophthora thermophila*, and *Fusarium oxysporum* disclosed in U.S. Pat. No. 4,435,307, U.S. Pat. No. 5,648,263, U.S. Pat. No. 5,691,178, U.S. Pat. No. 5,776,757, WO 89/09259, WO 96/029397, and WO 98/012307. Commercially available cellulases include Celluzyme™, Celluclean™, Carezyme™, Endolase™, Renozyme™ (Novozymes A/S), Clazinase™ and Puradax HA™ (Genencor International Inc.), and KAC-500 (B)™ (Kao Corporation).

Suitable peroxidases/oxidases include those of plant, bacterial or fungal origin. Chemically modified or protein engineered mutants are included. Examples of useful peroxidases include peroxidases from *Coprinus*, e.g. from *C. cinereus*, and variants thereof as those described in WO 93/24618, WO 95/10602, and WO 98/15257. Commercially available peroxidases include Guardzyme™ and Novozym™ 51004 (Novozymes A/S).

Enzyme Stabilizers

Any enzyme present in the composition may be stabilized using conventional stabilizing agents, e.g., a polyol such as propylene glycol or glycerol, a sugar or sugar alcohol, lactic acid, boric acid, or a boric acid derivative, e.g., an aromatic borate ester, or a phenyl boronic acid derivative such as 4-formylphenyl boronic acid, and the composition may be formulated as described in e.g. WO 92/19709 and WO 92/19708.

The indefinite article "a" or "an" and its corresponding definite article "the" as used herein means at least one, or one or more, unless specified otherwise.

Average molecular weights refer to weight average molecular weights.

Example 1

The following liquid formulations were made:

| | Reference example A | Reference example B | Example 1 |
|---|---|---|---|
| LAS | 4.9 | 4.9 | 4.9 |
| NI(7EO) | 7.3 | 7.3 | 7.3 |
| SLES(3EO) | 2.4 | 2.4 | 2.4 |
| Acid Violet 50 | 0 | 0.0036 | 0.0036 |
| Lignin sulfonate | 0 | 0 | 0.5 |
| water | remainder | remainder | remainder |

LAS is sodium $C_{11}$ to $C_{15}$ alkyl benzene sulphonate.

NI(7EO) is R—$(OCH_2CH_2)_n$OH, where R is an alkyl chain of C12 to C15, and n is 7.

SLES(3EO) is sodium lauryl ether sulfate with 3 ethoxy groups.

The lignin sulfonate used was Ultrazine NA (ex Borregaard LignoTech)

All values are wt %.

1 ml of the liquid detergent was placed onto a piece of woven cotton and left for 30 minutes. The cloth was then rinsed under a running tap of cold demineralised water for ten seconds and dried. The residual colour of the detergent on the cloth was measured using a reflectometer and expressed as the CIE L*a*b* values.

The staining was expressed as the Δb value which is the difference in staining with and without shading dye.

$$\Delta b = b(\text{reference example } A) - b(\text{liquid with dye}).$$

The results are given below:

| | Reference example B | Example 1 |
|---|---|---|
| Δb | 4.9 | 4.1 |

The laundry liquid formulation of Example 1 containing the lignin sulfonate gives 16% less neat contact fabric staining if compared with Reference B formulation, as shown by the smaller Δb value.

Example 2

The following liquid formulations were made:

| | Reference example C | Example 2 |
|---|---|---|
| LAS | 4.9 | 4.9 |
| NI(7EO) | 7.3 | 7.3 |
| SLES(3EO) | 2.4 | 2.4 |
| Direct Violet 9 | 0.0004 | 0.0004 |
| Lignin sulfonate | 0 | 0.5 |
| water | remainder | remainder |

Direct Violet 9 is the liquid dye product Pergasol Violet (ex BASF) All values are wt %.

1 ml of the liquid detergent was placed onto a piece of woven cotton and left for 30 minutes. The cloth was then rinsed under a running tap of cold demineralised water for ten seconds and dried. The Δb values were obtained, following the method of example 1.

The results are given below:

| | Reference example C | Example 2 |
|---|---|---|
| Δb | 2.9 | 0.9 |

The laundry liquid formulation of Example 2 containing the lignin sulfonate gives 69% less neat contact fabric staining if compared with Reference C formulation, as shown by the smaller Δb value.

We claim:

1. A composition comprising:

(a) from 0.00001 to 0.05 wt % of a shading dye having a chromophore, wherein the chromophore is selected from the group consisting of: mono-azo, bis-azo, triphenodioxazine, phthalocyanin, naptholactam, azine and anthraquinone; and wherein the shading dye comprises at least one sulfonate group;

(b) from 1 to 70 wt % of a surfactant;

(c) from 0.1 to 30 wt % of a modified lignin polymer;

(d) the remainder of the composition being diluents and adjuncts to 100 wt % and wherein the composition is a liquid laundry detergent.

2. The composition according to claim 1, wherein the modified lignin polymer is a lignin that has been substituted with anionic, cationic or alkoxy groups, or mixtures thereof.

3. The composition according to claim 2, wherein the modified lignin polymer is a lignin that has been substituted on an aliphatic portion of the lignin.

4. The composition according to claim 1, wherein the modified lignin polymer is a lignin that has been substituted on an aliphatic portion of the lignin with at least one anionic group.

5. The composition according to claim 4, wherein the modified lignin polymer is a lignin sulfonate.

6. The composition according to claim 1, wherein the modified lignin polymer is a lignin that has been substituted on an aliphatic portion of the lignin with at least one cationic group.

7. The composition according to claim 6, wherein the at least one cationic group includes at least one quaternary amine.

8. The composition according to claim 1, wherein the modified lignin polymer is a lignin that has been substituted on an aliphatic portion of the lignin with at least one alkoxy group.

9. The composition according to claim 8, wherein the at least one alkoxy group includes at least one polyalkylene oxide chain having repeat units of alkoxy moieties in the range from 5 to 30.

10. The composition according to claim 9, wherein the repeat units are ethoxy moieties.

11. The composition according to claim 1, wherein the shading dye is selected from the group consisting of direct dyes, acid dyes, hydrophobic dyes, cationic dyes, reactive dyes, and combinations thereof.

12. A method comprising the steps of:

(i) applying a liquid laundry composition to a textile wherein the liquid laundry composition comprises:

(a) from 0.00001 to 0.05 wt % of a shading dye having a chromophore, wherein the chromophore is selected from the group consisting of: mono-azo, bis-azo, triphenodioxazine, phthalocyanin, naptholactam, azine and anthraquinone; and wherein the shading dye comprises at least one sulfonate group;

(b) from 1 to 70 wt % of a surfactant;

(c) from 0.1 to 30 wt % of a modified lignin polymer; and, (d) the remainder of the composition being diluents and adjuncts to 100 wt %;

(ii) rinsing the textile with water; and, (iii) drying the textile.

* * * * *